US008555521B2

(12) United States Patent
Bies et al.

(10) Patent No.: US 8,555,521 B2
(45) Date of Patent: Oct. 15, 2013

(54) METHOD OF TREATMENT OF WOODEN ITEMS

(71) Applicants: Gary D. Bies, Lincoln, ME (US); Raymond R. Emery, Lincoln, ME (US); Donald Martin Perkins, Ronan, MT (US)

(72) Inventors: Gary D. Bies, Lincoln, ME (US); Raymond R. Emery, Lincoln, ME (US); Donald Martin Perkins, Ronan, MT (US)

(73) Assignee: Hot-Woods, LLC, Ronan, MT (US)

( * ) Notice: Subject to any disclaimer, the term of this patent is extended or adjusted under 35 U.S.C. 154(b) by 0 days.

(21) Appl. No.: 13/765,432

(22) Filed: Feb. 12, 2013

(65) Prior Publication Data

US 2013/0153087 A1 Jun. 20, 2013

Related U.S. Application Data

(63) Continuation-in-part of application No. 13/248,648, filed on Sep. 29, 2011, now Pat. No. 8,453,343, and a continuation-in-part of application No. 12/714,592, filed on Mar. 1, 2010, now Pat. No. 8,141,604, and a continuation-in-part of application No. 12/686,124, filed on Jan. 12, 2010, now abandoned.

(51) Int. Cl.
*F26B 3/00* (2006.01)

(52) U.S. Cl.
USPC ..... 34/396; 144/364; 42/71.02

(58) Field of Classification Search
USPC ..... 34/396, 407, 413, 467, 488, 497, 90, 34/218, 242; 144/356, 360, 364, 380, 358; 428/548, 292.1; 60/618; 374/16; 426/631; 42/71.01, 71.02
See application file for complete search history.

(56) References Cited

U.S. PATENT DOCUMENTS

| | | | | | |
|---|---|---|---|---|---|
| 3,985,169 | A * | 10/1976 | Chow | 144/347 |
| 4,259,148 | A * | 3/1981 | Beath et al. | 162/24 |
| 5,527,579 | A * | 6/1996 | Aho | 428/50 |
| 6,293,121 | B1 * | 9/2001 | Labrador | 62/304 |
| 6,910,284 | B2 * | 6/2005 | Romeiro de Aguiar et al. | 34/476 |
| 7,674,522 | B2 * | 3/2010 | Pohlmann | 428/323 |
| 8,273,201 | B2 * | 9/2012 | Pohlmann | 156/62.2 |
| 8,453,343 | B2 * | 6/2013 | Emery et al. | 34/396 |
| 2008/0155985 | A1 * | 7/2008 | Labrador | 60/698 |
| 2009/0163365 | A1 * | 6/2009 | Bentlage et al. | 504/360 |
| 2012/0018045 | A1 * | 1/2012 | Emery et al. | 144/364 |

FOREIGN PATENT DOCUMENTS

| | | | | |
|---|---|---|---|---|
| EP | 0922918 | A1 | 6/1999 | |
| JP | 2005054132 | A * | 3/2005 | C10B 53/02 |
| WO | WO 2009056009 | A1 * | 5/2009 | B27N 3/04 |

* cited by examiner

*Primary Examiner* — Steve M Gravini
(74) *Attorney, Agent, or Firm* — Anthony D. Pellegrini

(57) ABSTRACT

An improved method for the treatment of wood in preparation for manufacture of wooden items comprising the steps of first heat treating the wood and then fashioning the wood into a finished item, whereby the resulting wooden item is darker, harder, more weather and rot resistant, and more stable than items fashioned from untreated wood.

24 Claims, 2 Drawing Sheets

METHOD OF TREATMENT OF WOODEN ITEMS

CROSS REFERENCE TO RELATED APPLICATION

This application is a continuation in part of U.S. Ser. No. 13/248,648, filed Sep. 29, 2011 and currently pending, entitled Method Of Treatment Of Wooden Items, by Emery, Raymond, et al., which is hereby incorporated by reference; a continuation in part of U.S. Ser. No. 12/714,592, filed Mar. 1, 2010 and issued as U.S. Pat. No. 8,141,604 on Mar. 27, 2012, entitled Method Of Manufacture For Wooden Gunstocks, by Emery, Raymond, et al., which is hereby incorporated by reference; and a continuation in part of U.S. Ser. No. 12/686,124, filed Jan. 12, 2010, now abandoned, entitled Improved Method Of Manufacture For Wooden Gunstocks, by Emery, Raymond, et al., which is hereby incorporated by reference.

BACKGROUND OF THE INVENTION

1. Technical Field

The invention relates generally to the field of wooden items, such as musical instrument components, gunstocks, tools, and the like, and is directed to a method of treatment of wood in preparation of manufacture of wooden items. More specifically, the invention is directed to a method for heat treating suitable wood to achieve desirable characteristics for the wooden items made thereof while preserving the aesthetics of natural wood.

2. Description of Prior Art

Wood used in the manufacture of musical instruments, gunstocks, tool handles, and other high end items needs to be both structurally sound and aesthetically pleasing. Especially for musical instruments and gunstocks, wooden components must be sufficiently hard, have low moisture content and low moisture absorption properties, must be highly stable (that is, resistant to shrinkage and swelling), and be insect resistant. The shrinking and expansion of components of a musical instrument can alter the sound of the instrument and prevent it from producing a musically pleasing sound, and the shrinking and expansion of a gunstock, however slight, can affect the accuracy of the firearm.

Because wood is often not sufficiently hard, with low moisture content and absorption properties, and may be unstable and susceptible to shrinking and expansion, manufacturers of high end items have recently opted to use synthetic materials, which are more likely to achieve the desired properties. Nevertheless, using wood for high end items is still desirable, for their aesthetics and tactile qualities, as well as historical fidelity, and therefore a method of manufacture of wooden items that overcomes the deficiencies of traditional wooden items is desired.

One method for decreasing the susceptibility of wooden items to moisture and rot is to chemically treat the wood before fashioning it into a finished item. A common method of chemically treating wood is the "pressure treatment" method, in which the wood is treated with chemicals such as arsenic and chromium (Chromate Copper Arsenate), alkaline copper quaternary (ACQ), or copper azole preservative, applied to the wood using a vacuum and pressure cycle to force the chemicals deep into the inner portions of the wood. Other chemicals may also be used. While this method tends to improve the weather resistance as well as insect and rot resistance of the wood, it does not address swelling and shrinkage issues. The toxicity of the chemicals used also renders this method less than desirable.

Another method for decreasing the susceptibility of wooden items to moisture and rot is to treat the wood in a non-pressurized manner with preservatives. These preservatives may be chemically based or derived from naturally occurring compounds, such as oils, and the preservatives are applied to the surface of the wood. While this method tends to be simpler than the pressure treatment method, and potentially uses less toxic preservatives, it fails to ensure a uniform application of the preservative into the inner portions of the wood. It also does not address swelling and shrinkage issues.

There is known in the art yet another method for decreasing the susceptibility of wooden items to moisture and rot, which is preferable to the above-described methods. Wood may be heat treated prior to being fashioned into a gunstock. European Patent Application EP 0 922 918 A1 (Aug. 3, 1998), to Lallukka, Tero, for "Method for heat treatment of timber", discloses such a method for treating wood.

Wood is made up, generally, of cellulose, lignin, and extractives. Cellulose (and hemicelluloses) are carbohydrates that are structural components in wood. Cellulose constitutes 40-50% and hemicelluloses 25-35% of wood. The composition and contents of hemicelluloses vary from one wood species to another. During heat treatment, both groups undergo changes, but the majority of the changes occur in hemicelluloses. After heat treatment, the wood contains a substantially lower amount of hemicelluloses. As a result of this, the amount of fungi susceptible material is significantly lower, providing one reason for heat-treated woods improved resistance to fungal decay compared with normal kiln dried wood. With the degrading of the hemicelluloses, the concentration of water-absorbing components decreases and the dimensional stability of treated wood is also improved compared to normal kiln dried wood. The decomposition temperature of the hemicelluloses is about 200-260° C., and the corresponding temperature for cellulose is about 240-350° C. Lignin holds the wood cells together. Lignin constitutes 20-30% of wood. During heat treatment, bonds between components of lignin are partially broken. Of all wood's constituents, lignin has the best ability to withstand heat. Lignin's mass starts to decrease when the temperature exceeds 200° C. Wood also contains minor amounts of small-molecule constituents known as extractives. Extractives constitute less than 5% of wood. Extractives are not structural components in wood, and most of the compounds evaporate easily during the heat treatment.

Heat treating wood changes the structure of the wood in a manner which is desirable for the manufacture of many different kinds of high end wooden items. During heat treatment, wood undergoes mild pyrolysis, resulting in degradation of hemicelluloses and amorphous cellulose, modification of lignin structures, and evaporation of extractives from the wood. The lignin and hemicelluloses become less hygroscopic. Surface hardness increases, moisture is 10%-50% less than in untreated wood, resins dry out or evaporate, less absorption of moisture occurs, as well as reduced molding, improved weather resistance, and moisture deformation is reduced by 30% to 90% over untreated wood.

Thermally modified wood has a lower density than untreated wood. This is mainly due to the changes of the mass during the treatment when wood loses its weight. Density decreases as higher treatment temperatures are used. This leads to overall lighter weight of the wood. The strength of wood has a strong correlation with density. Because thermally modified wood has slightly lower density after the treatment, it is somewhat less strong than untreated wood. However, the change in the weight-to-strength ratio is minimal. The strength of wood is also highly dependent on the moisture content and its relative level below the grain saturation point. Thermally modified wood benefits due to its lower equilibrium moisture content. Heat treated wood is therefore sufficiently strong for use in high end wooden items.

Heat treatment also significantly reduces the tangential and radial swelling of wood. Heat-treated wood consequently has very low shrinkage. The water permeability of heat-treated wood is 20-30 percent lower than that of normal kiln dried wood. Thermally modified wood is resistant to insects (which are attracted to the extractives of untreated wood; such extractives are largely evaporated away during heat treatment).

Species of tree which are suitable for thermal modification include American Beech (*Fagus Grandifolia*), Red Maple (*Acer Rubrum*), Black Walnut (*Juglans Nigra*), Hard maple (*Acer Saccharum*), Turkish Walnut a/k/a English Walnut (*Juglans Regia*), California Walnut (*Juglans Californica*), Yellow Birch (*Betula Alleghaniensis*), and Claro Walnut (*Juglans Hindsii*). Other species are also suitable for thermal modification.

Some woods naturally exhibit the preferred characteristics described above. For example, with regard to wood hardness, Madagascar ebony (*Diospyros celebica*) measures 3220 on the Janka Hardness Scale. (The Janka Hardness Scale measures the resistance of a type of wood to withstand denting and wear, measuring the force required to embed an 11.28 mm (0.444 in) steel ball into wood to half the ball's diameter; the measurement is expressed in pounds-force (lbf).) In contrast, the hardness of hard maple (*A. saccharum*) is only 1450 on the Janka Hardness Scale. A soft wood such as eastern white pine (*Pinus strobus*) has a hardness of only 380 on the Janka Hardness Scale.

However, ebony falls under the Lacey Act of 1900, which was amended in 2008 to include provisions to curtail illegal logging. The amended Lacey Act prohibits all trade in plant and plant products (e.g., furniture, paper, or lumber) that are illegally sourced from any U.S. state or any foreign country; requires importers to declare the country of origin of harvest and species name of all plants contained in their products; and establishes penalties for violation of the Act, including forfeiture of goods and vessels, fines, and jail time. Because ebony is relatively rare, procurement of ebony often is not done consistent with the provisions of the Lacey Act. Ebony is thus difficult to obtain, and the legal supply is not sufficient to meet demand.

As a result, manufacturers have a need for a substitute wood that meets the characteristics of ebony, but which is in greater supply. One species that is an acceptable substitute is ipe (*Tabebuia Serratifolia*), a common specie of wood found abundantly in South America. Ipe has a hardness on the Janka Hardness Scale of 3684, making it sufficiently hard. However, while ipe has a naturally dark color it is nowhere near the true black of ebony. Ipe therefore must be modified to achieve proper coloration. Thermally modifying ipe brings it closer to the color of ebony than any other species of wood while retaining the hardness that is necessary. In addition, thermal modification dries the wood and reduces its susceptibility to shrinkage or swelling, as well as making it more insect resistant. In addition to ipe, there are a few other species of wood that are sufficiently hard and sufficiently abundant that they can be acceptable substitutes for ebony when they are thermally treated. These include purpleheart (*Peltogyne paniculata*), Brazilian walnut (*Swartzia tomentosa*), and cumaru (*Dipyeryx odorata*).

In summary, heat treating wood reduces its moisture content; it reduces the ability of the wood to absorb environmental moisture; it increases the surface hardness of the wood; it increases the overall stability of the wood (that is, minimizes expansion and shrinkage); it causes the wood to become less dense, and therefore lighter; and it makes the wood less susceptible to rot and insect predation. It also allows for aesthetically pleasing coloration changes to the wood. Heat treatment of wood further accomplishes these desirable characteristics without the use of toxic chemicals.

From the foregoing it is evident that there is a need for a method of treatment of wood for the manufacture for wooden items, particularly components for musical instruments, gunstocks, tool handles, and other high end items.

It is therefore an objective of the present invention to provide a method of heat treatment of wood for the manufacture of wooden items.

It is a further objective of the present invention to provide a method of heat treatment of wood for the manufacture of components for musical instruments, gunstocks, tool handles, and other high end items.

It is a further objective of the present invention to provide a method of heat treatment which darkens the color of wood.

It is a further objective of the present invention to provide a method that increases the surface hardness of the wood.

It is a further objective of the present invention to provide a method that reduces the moisture content of wooden items to minimize expansion and shrinkage and to increase the stability thereof.

It is a further objective of the present invention to provide a method that makes the wood less susceptible to environmental moisture.

It is a further objective of the present invention to provide a method that makes the wood less susceptible to rot and insect predation.

It is a further objective of the present invention to provide a method that decreases the density and therefore the weight of the wood.

It is a further objective of the present invention to provide a method which does not use toxic chemicals to treat the wood.

Other objectives of the present invention will be readily apparent from the description that follows.

SUMMARY

The present invention discloses a method of treatment of wood in preparation for the manufacture for wooden items. In one aspect, the present invention is directed to a method comprising the steps of obtaining a piece of wood of an appropriate species of tree; drying said piece of wood until said piece of wood has a moisture content of less than fifteen percent (15%); placing said piece of wood into an oven heated to between 150° C. and 240° C.; allowing said piece of wood to be heated by the oven for between 2 and 96 hours such that said piece of wood achieves a temperature of at least 150° C.; removing said piece of wood from the oven and allow said piece of wood to cool to substantially room temperature; and cutting said piece of wood into a finished wooden item.

In an alternate aspect of the present invention, the method comprises the additional step of creating a rough wooden item after selecting a piece of wood of an appropriate species of tree, then drying the rough wooden item, heating it, allowing it to cool, and then manufacturing the rough wooden item into a finished wooden item.

In yet another alternate aspect of the present invention, the method comprises the steps of first obtaining a pre-fabricated rough wooden item, then drying the wooden item, heating it, allowing it to cool, and then and then manufacturing the rough wooden item into a finished wooden item.

Other features and advantages of the invention are described below.

DESCRIPTION OF THE INVENTION

Figure 1:
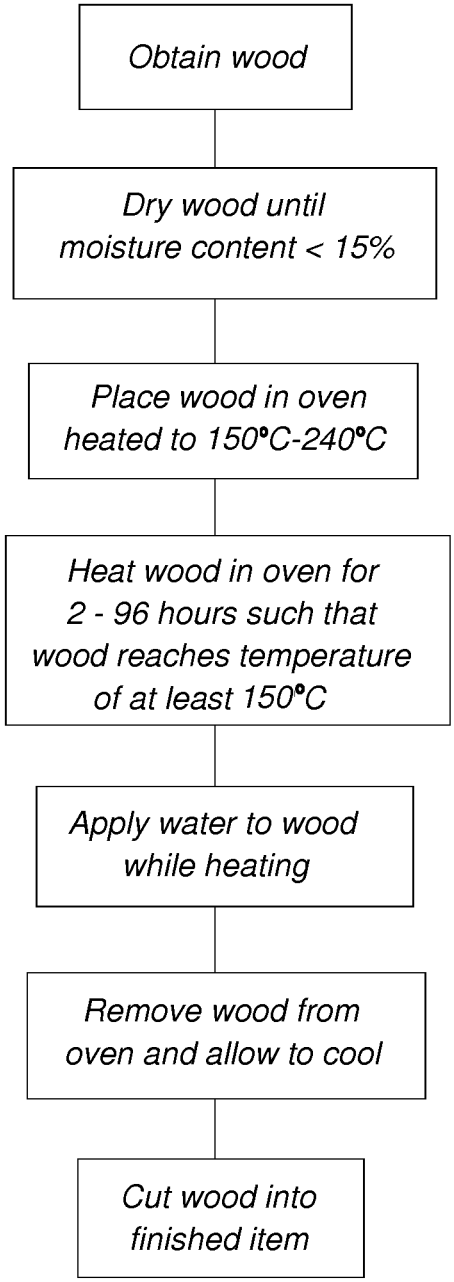
FIG. 1 is a flow chart of the steps of one embodiment of the method.
Figure 2:
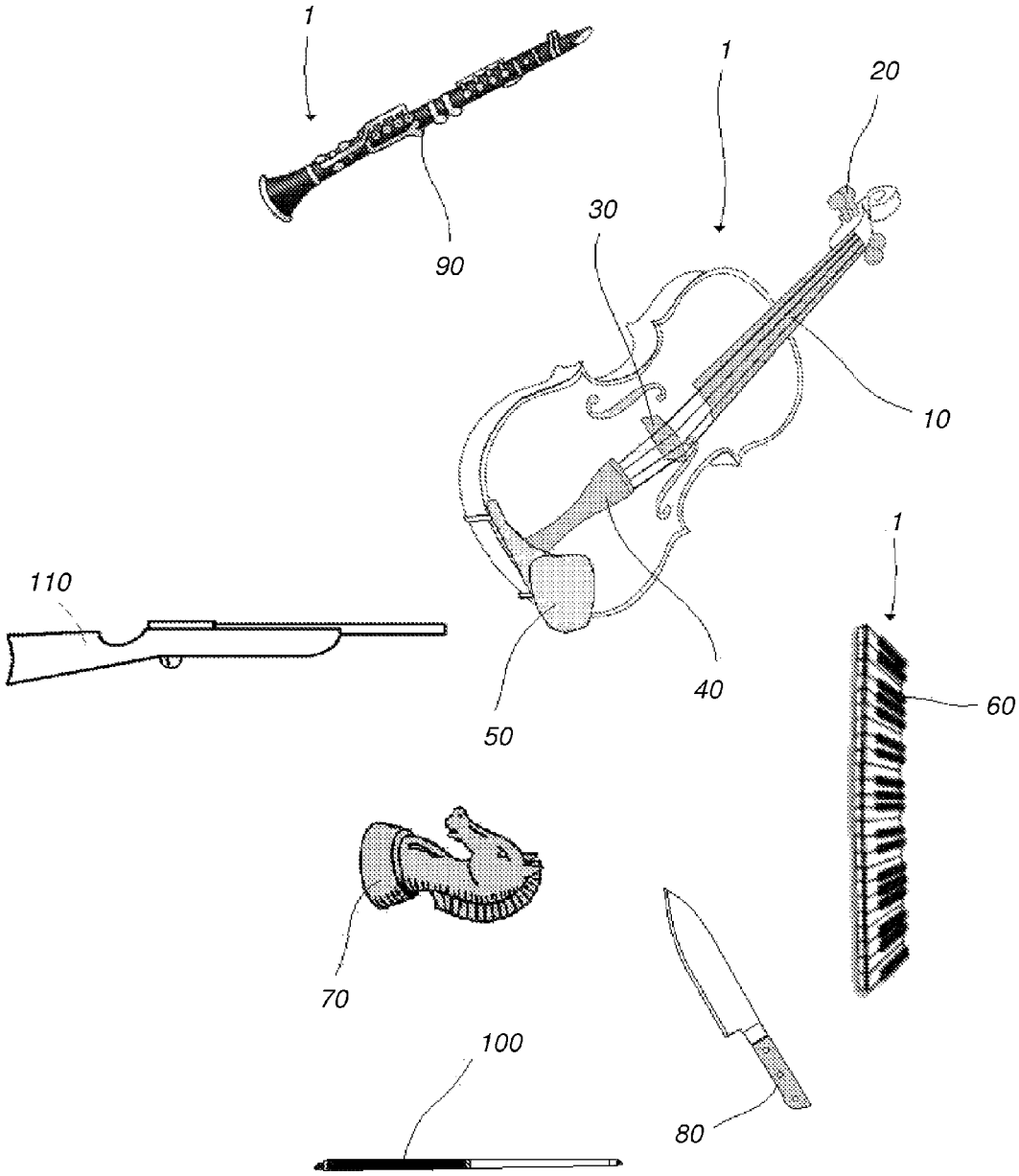
FIG. 2 depicts several exemplars of items that can be manufactured from wood treated by the method of the present invention.

The method disclosed herein is for the treatment of wood to be used in the manufacture of wooden items, for example, components of musical instruments 1, gunstocks 110, tool handles 80, and the like. The basic method comprises the following steps:

Step A. obtain a piece of wood of an appropriate species of tree having certain characteristics desirable for the manufacture of wooden items, namely, hardness, strength, and stability, and the wood should be aesthetically pleasing.

Suitable species of tree include African Blackwood (*Dalbergia melanoxylon*), African Zebrawood (*Microberlinia brazzavillensis*), Afzelia (*Afzelia africana*), Agba (*Gossweilerodendron balsamiferum*), American Basswood (*Tilia americana*), American Beech (*Fagus grandifolia*), American Elm (*Ulmus americana*), American Hornbeam (*Carpinus caroliniana*), American Sycamore (*Platanus occidentalis*), Applewood (*Malus sylvestris*), Arizona Cypress (*Cupressus arizonica*), Australian Blackwood (*Acacia melanoxylon*), Australian Ironwood (*Casuarina equisetifolia*), Australian Sandalwood (*Santalum spicatum*), Ayan (*Distemonanthus benthamianus*), Bald Cypress (*Taxodium distichum*), Balsam Fir (*Abies balsamea*), Balsam Poplar (*Populus balsamifera*), Bigleaf Mahogany (*Swietenia macrophylla*), Bigtooth Aspen (*Populus grandidentata*), Black Alder (*Alnus glutinosa*), Black Ash (*Fraxinus nigra*), Black Cherry (*Prunus serotina*), Black Ironwood (*Krugiodendron ferreum*), Black Locust (*Robinia pseudacacia*), Black Maple (*Acer nigrum*), Black Oak (*Quercus velutina*), Black Poplar (*Populus nigra*), Black Spruce (*Picea mariana*), Black Walnut (*Juglans nigra*), Black Willow (*Salix nigra*), Blackbean (*Castanospermum australe*), Blackbutt (*Eucalyptus pilularis*), Blackgum (*Nyssa sylvatica*), Bloodwood (*Brosimum paraense*), Blue Ash (*Fraxinus quadrangulata*), Blue Gum (*Eucalyptus saligna*), Bocote (*Cordia alliodora*), Boxelder (*Acer negundo*), Boxwood (*Buxus sempervirens*), Brazilian walnut (*Swartzia tomentosa*), Brazillian Rosewood (*Dalbergia nigra*), Brazilwood (*Caesalpinia echinata*), Brown Mallet (*Eucalyptus astringens*), Bubing a (*Guibourtia demeusei*), Bur oak (*Quercus macrocarpa*), Butternut (*Juglans cinerea*), California Laurel (*Umbellularia californica*), California Walnut (*Juglans californica*), Camphor Laurel (*Cinnamomum camphora*), Canyon Live Oak (*Quercus chrysolepis*), Cape Chestnut (*Calodendrum capense*), Carapa (*Carapa guianensis*), Catalina Ironwood (*Lyonothamnus floribundus*), Celery Top Pine (*Phyllocladus aspleniifolius*), Chestnut (*Castanea dentata*), Chestnut Oak (*Quercus prinus*), Chinese Mahogany (*Toona sinensis*), Chinkapin Oak (*Quercus muhlenbergii*), Cigar Tree (*Catalpa speciosa*), Claro Walnut (*Juglans hindsii*), Coachwood (*Ceratopetalum apetalum*), Cocobolo (*Dalbergia retusa*), Common Ash (*Fraxinus excelsior*), Common Horse-chestnut (*Aesculus hippocastanum*), Common Ironwood (*Pau ferro*), Corkwood (*Leitneria floridana*), Corsican Pine (*Pinus nigra*), Cucumbertree (*Magnolia acuminata*), cumaru (*Dipyeryx odorata*), Desert Ironwood (*Olneya tesota*), Eastern Cottonwood (*Populus deltoides*), Eastern Hemlock (*Tsuga canadensis*), Eastern Hop hornbeam (*Ostrya virginiana*), Eastern Redcedar (*Juniperus virginiana*), Eastern White Pine (*Pinus strobus*), English Elm (*Ulmus procera*), English Oak (*Quercus robur*), European Aspen (*Populus tremula*), European Beech (*Fagus sylvatica*), European Larch (*Larix decidua*), European Yew (*Taxus baccata*), Flooded Gum (*Eucalyptus grandis*), Flowering Dogwood (*Cornus florida*), Goncalo Alves (*Astronium fraxinifolium*), Gray Birch (*Betula populifolia*), Green Ash (*Fraxinus pennsylvanica*), Greenheart (*Chlorocardium rodiei*), Grey Ironbark (*Eucalyptus paniculata*), Guanandi (*Calophyllum brasiliense*), Hackberry (*Celtis occidentalis*), Hard maple a/k/a Sugar Maple (*Acer saccharum*), Hawaiian Sandalwood (*Santalum freycinetianum*), Hinoki Cypress (*Chamaecyparis obtusa*), Honey Locust (*Gleditsia triacanthos*), Hoop Pine (*Araucania cunninghamii*), Huon Pine (*Lagarostrobos franklinii*), Hybrid Poplar (*Populus canadensis*), Indian Bean Tree (*Catalpa bignonioides*), Indian Rosewood (*Dalbergia sissoo*), Indian Sandalwood (*Santalum album*), Ipe (*Tabebuia serratifolia*), Iroko (*Milicia excelsa*), Ironbark (*Eucalyptus sideroxylon*), Jacaranda (*Jacaranda brasiliana*), Jack Pine (*Pinus banksiana*), Japanese Larch (*Larix kaempferi*), Jarrah (*Eucalyptus marginate*), Jatobá (*Hymenaea courbaril*), Karri (*Eucalyptus diversicolor*), Kauri (*Agathis australis*), Kaya (*Torreya nucifera*), Kingwood (*Dalbergia cearensis*), Lacewood (*Grevillea robusta*), Laurel Oak (*Quercus laurifolia*), Lawson's Cypress (*Chamaecyparis lawsoniana*), Lebombo Ironwood *Androstachys johnsonii*), Lignum Vitae (*Guaiacum officinale*), Limba (*Terminalis superba*), Loblolly Pine (*Pinus taeda*), Lodgepole Pine (*Pinus contorta*), Longleaf Pine (*Pinus palustris*), Marblewood (*Marmaroxylon racemosum*), Marri (*Corymbia calophylla*), Mediterranean Cypress (*Cupressus sempervirens*), Merbau (*Intsia bijuga*), Mockernut Hickory (*Carya alba*), Monterey Pine (*Pinus radiata*), Mountain Hemlock (*Tsuga mertensiana*), Noble Fir (*Abies procera*), Nootka Cypress (*Callitropsis nootkatensis*), Northern Whitecedar (*Thuja occidentalis*), Norway Spruce (*Picea abies*), Nuttall's Oak (*Quercus texana*), Obeche (*Triplochiton scleroxylon*), Ohio Buckeye (*Aesculus glabra*), Okoumé (*Aucoumea klaineana*), Olive (*Olea europaea*), Oregon Ash (*Fraxinus latifolia*), Overcup Oak (*Quercus lyrata*), Pacific Coast Mahogany (*Swietenia humilis*), Pacific Dogwood (*Cornus nuttallii*), Pacific Silver Fir (*Abies amabilis*), Padauk (*Pterocarpus soyauxii*), Panga-panga (*Millettia stuhlmannii*), Paper Birch (*Betula papyrifera*), Parana Pine (*Araucaria angustifolia*), Pear (*Pyrus communis*), Pecan (*Carya illinoinensis*), Pehuén (*Araucaria araucana*), Persian Ironwood (*Parrotia persica*), Pignut Hickory (*Carya glabra*), Pink Ivory (*Berchemia Zeyheri*), Pitch Pine (*Pinus rigida*), Plains Cottonwood (*Populus sargentii*), Ponderosa Pine (*Pinus ponderosa*), Post Oak (*Quercus stellata*), Pumpkin Ash (*Fraxinus profunda*), Purple Heart (*Peltogyne altissima*), Purpleheart (*Peltogyne paniculata*), Quaking Aspen (*Populus tremuloides*), Queensland Maple (*Flindersia brayleyana*), Queensland Walnut (*Endiandra palmerstonii*), Red Alder (*Alnus rubra*), Red Cedar (*Toona ciliata*), Red Cherry (*Prunus pensylvanica*), Red Elm (*Ulmus rubra*), Red Mahogany (*Eucalyptus resinifera*), Red Maple (*Acer rubrum*), Red Oak (*Quercus rubra*), Red Pine (*Pinus resinosa*), Red Spruce (*Picea rubens*), Redgum (*Liquidambar styraciflua*), Redheart (*Erythroxylon mexicanum*), Redwood (*Sequoia sempervirens*), Rimu (*Dacrydium cupressinum*), River Birch (*Betula nigra*), River Red Gum (*Eucalyptus camaldulensis*), Rock Elm (*Ulmus thomasii*), Rocky Mountain Douglas-fir (*Pseudotsuga menziesii*), Rose Chestnut (*Mesua ferrea*), Sal (*Shorea robusta*), Sapele (*Entandrophragma cylindricum*), Sassafras (*Sassafras albidum*), Satinwood (*Chloroxylon swietenia*), Scots Pine (*Pinus sylvestris*), Shagbark Hickory (*Carya ovata*), Shellbark Hickory (*Carya laciniosa*), Sheoak (*Allocasuarina casuarinaceae*), Shortleaf Pine (*Pinus echinata*), Silver Birch (*Betula pendula*), Silver Fir (*Abies alba*), Silver Maple (*Acer saccharinum*), Silver Wattle (*Acacia dealbata*), Sitka Spruce (*Picea sitchensis*), Sonokeling (*Dalbergia latifolia*), Sourwood (*Oxydendrum arboreum*), Southern Blue Gum (*Eucalyptus globulus*), Southern Live Oak (*Quercus virginiana*), Southern Mahogany (*Eucalyptus botryoides*), Southern Red Oak (*Quercus falcata*), Southern Sassafras (*Atherosperma moschatum*), Southern Whitecedar (*Chamaecyparis thyoides*), Spanish-cedar (*Cedrela odorata*), Sugar Pine (*Pinus lambertiana*), Sugi (*Cryptomeria japonica*), Swamp Chestnut Oak (*Quercus michauxii*), Swamp Cottonwood (*Populus heterophylla*), Swamp Mahogany (*Eucalyptus robusta*), Swamp White Oak (*Quercus bicolor*), Sweet Birch (*Betula lenta*), Sycamore Maple (*Acer pseudoplatanus*), Tallowwood (*Eucalyptus microcorys*), Tamarack Larch (*Larix laricina*), Tambotie (*Spirostachys africana*), Tasmanian Oak (*Eucalyptus regnans*), Teak (*Tectona grandis*), Tupelo Gum (*Nyssa aquatica*), Turkish Walnut a/k/a English Walnut (*Juglans regia*), Turpentine (*Syncarpia glomulifera*), Wandoo (*Eucalyptus wandoo*), Water Oak (*Quercus nigra*), Weeping Willow (*Salix babylonica*), Wenge (*Millettia laurentii*), West Indies Mahogany (*Swietenia mahagoni*), Western Hemlock (*Tsuga heterophylla*), Western Larch (*Larix occidentalis*), Western Redcedar (*Thuja plicata*), Western White Pine (*Pinus monticola*), White Ash (*Fraxinus americana*), White Basswood (*Tilia heterophylla*), White Birch (*Betula pubescens*), White Mahogany (*Eucalyptus acmenoides*), White Oak (*Quercus alba*), White Spruce (*Picea glauca*), White Willow (*Salix alba*), Wild Cherry (*Prunus avium*), Willow Oak (*Quercus phellos*), Wych Elm (*Ulmus glabra*), Yellow Birch (*Betula alleghaniensis*), Yellow Birch (*Betula lutea*), Yellow Buckeye (*Aesculus flava*), Yellow Lapacho (*Tabebuia serratifolia*), Yellow Poplar (*Liriodendron tulipifera*), and York Gum (*Eucalyptus loxophleba*). Other species of tree may also be used.

Step B. dry said piece of wood until said piece of wood has a moisture content of less than fifteen percent.

Step C. place said piece of wood into an oven heated to between 150° C. and 240° C.

Step D. allow said piece of wood to be heated by oven for between 2 and 96 hours such that said piece of wood achieves a temperature of at least 150° C.

Step E. remove said piece of wood from oven and allow said piece of wood to cool to substantially room temperature.

The foregoing Steps A through E are to be performed consecutively.

The wooden item to be manufactured from the wood treated by the method of the present invention may be one or more of the following: acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard 10, violin tuning peg 20, violin bridge 30, violin tail piece 40, violin chin rest 50, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key 60, organ key, clarinet body 90, oboe body, gunstock 110, knife handle 80, pool cue 100, toy game piece, chess piece 70, baseball bat, bed frame, bench, bookcase, bowl, box, bureau, cabinet, chair, chest, clock casing, coat rack, desk, door, flooring, furniture, musical instrument, nightstand, oar, paddle, rack, religious statuary, serving ware, sporting equipment, table, tool handle, wooden toy, kitchen utensil, window frame, window sill, wood carving, or wooden bathtub. Other wooden items requiring hardness may also be manufactured from wood treated by the method of the present invention.

Referring to Step B, the piece of wood is dried until it has a moisture content of less than fifteen percent (15%). The drying can be performed by any means known in the art, including air drying, kiln drying, or other means. While the moisture content can be any amount less than fifteen percent (15%), the dryer the wood the better, with a moisture content of ten percent (10%) or even five percent (5%) being desirable.

Referring to Step C, the dried piece of wood is placed into an oven heated to between 150° C. and 240° C. The oven may be any type of oven known in the art which can attain the appropriate temperatures and maintain substantially constant temperatures over time. The oven may be preheated to the desired temperature before the wood is placed therein, or it may be preheated to a preliminary, lower temperature before the wood is placed therein and thereafter heated to the desired temperature, or it may not be preheated at all, with the wood being placed in a cold oven and then the oven temperature raised to the desired temperature. In the preferred embodiment, the oven will be preheated to an intermediate temperature, preferably in excess of 100° C. The wood will be placed into the oven and then the oven temperature will be gradually raised to the desired temperature, at a substantially constant rate of increase. The preferred temperature is between 160° C. and 190° C.

Referring to Step D, the piece of wood remains in the oven to be heated at the desired temperature for between 2 and 96 hours such that the piece of wood achieves an internal temperature of at least 150° C. In the preferred embodiment the wood is heated for 36 to 72 hours, depending on the amount of wood in the oven and the species. The oven will be maintained at substantially the preferred temperature for the duration of Step D.

In one embodiment of the method, an additional Step D' is performed, concurrently with Step D. In Step D', while the piece of wood is being heated in the oven in Step D, a treatment is applied to the wood. The treatment may be any substance which enhances the structural changes occurring to the wood during heating. In the preferred embodiment the treatment is a coolant. The application of a coolant to the wood protects the surface of the wood from scorching. Because the outer surface of the wood becomes heated before the inner core of the wood, the prolonged exposure to heat necessary to heat the inner core of the wood could raise the outer surface to excessive temperatures, potentially resulting in surface damage. The coolant attenuates the surface temperature of the wood to prevent excessive heating thereof. Any form of liquid or gaseous coolant may be used. In one embodiment the preferred coolant is water. Water may be applied in liquid form to the wood during Step D. In the preferred embodiment water is applied to the wood in the form of steam. In other embodiments chemical treatments can be applied to the wood to protect the surface. The treatment may be applied continuously, or in the preferred embodiment it may be applied periodically to the wood. The timing of the application of treatment to the wood may be computer controlled to achieve the desired surface temperature of the wood for maximum protection during heating.

Referring to Step E, after the wood has been heated for the desired length of time it is removed from the oven and allowed to cool. In one embodiment the wood is simply removed from the oven without first lowering the oven temperature. In another embodiment the oven temperature is lowered prior to the removal of the wood. In this embodiment the oven temperature will be gradually lowered to an intermediate temperature, preferably in excess of 100° C., with the lowering of the oven temperature occurring at a substantially constant rate. In the most preferred embodiment the rate of decrease in temperature will be substantially the same as the rate of increase in temperature at the beginning of Step D. Once the intermediate temperature is reached the wood is removed from the oven. In all embodiments, once the wood is removed from the oven it is allowed to cool to substantially room temperature. This cooling process may be accelerated by moving cool air over the wood by the use of fans, or by placing the wood into a cooled space, such as a refrigeration unit. Alternatively, the wood may be allowed to cool simply by leaving it out in a storage area.

In preferred embodiments of the method of the present invention, an optional Step F is performed, whereby once the wood has suitably cooled it is cut into a finished wooden item. The wood may be cut in Step F by any practical means known in the art, including with hand tools, power tools, computer-controlled cutting devices, and the like. In the most preferred embodiments, finished wooden items are created by use of a computerized finishing machine.

An alternate method includes the optional step of, after selecting the appropriate piece of wood, creating a rough wooden item from the selected piece of wood before drying begins. The rough wooden item is then dried, heated, and cooled as before, and then optionally manufactured into a finished wooden item, as described above.

Yet another alternate method includes the initial step of obtaining a rough wooden item created from a piece of wood. The wood may be chosen from the same group of species of tree identified above. Other species of tree may also be used. The rough wooden item is then dried, heated, and cooled as before, and then optionally manufactured into a finished wooden item, as described above.

Modifications and variations can be made to the disclosed embodiments of the method without departing from the subject or spirit of the method as defined in the following claims.

What we claim:

1. A method of preparing a wooden item, said method comprising the following steps:

A. obtain a piece of wood;

B. dry said piece of wood until said piece of wood has a moisture content of less than fifteen percent;

C. place said piece of wood into an oven heated to between 150° C. and 240° C.;

D. allow said piece of wood to be heated by oven for between 2 and 96 hours such that said piece of wood achieves an internal temperature of at least 150° C.; and E. remove said piece of wood from oven and allow said piece of wood to cool to substantially room temperature;

whereby Steps A through E are to be performed consecutively.

2. The method of claim 1 wherein the piece of wood obtained in Step A is chosen from the group of the following species of tree: African Blackwood (*Dalbergia melanoxylon*), African Zebrawood (*Microberlinia brazzavillensis*), Afzelia (*Afzelia africana*), Agba (*Gossweilerodendron balsamiferum*), American Basswood (*Tilia americana*), American Beech (*Fagus grandifolia*), American Elm (*Ulmus americana*), American Hornbeam (*Carpinus caroliniana*), American Sycamore (*Platanus occidentalis*), Applewood (*Malus sylvestris*), Arizona Cypress (*Cupressus arizonica*), Australian Blackwood (*Acacia melanoxylon*), Australian Ironwood (*Casuarina equisetifolia*), Australian Sandalwood (*Santalum spicatum*), Ayan (*Distemonanthus benthamianus*), Bald Cypress (*Taxodium distichum*), Balsam Fir (*Abies balsamea*), Balsam Poplar (*Populus balsamifera*), Bigleaf Mahogany (*Swietenia macrophylla*), Bigtooth Aspen (*Populus grandidentata*), Black Alder (*Alnus glutinosa*), Black Ash (*Fraxinus nigra*), Black Cherry (*Prunus serotina*), Black Ironwood (*Krugiodendron ferreum*), Black Locust (*Robinia pseudacacia*), Black Maple (*Acer nigrum*), Black Oak (*Quercus velutina*), Black Poplar (*Populus nigra*), Black Spruce (*Picea mariana*), Black Walnut (*Juglans nigra*), Black Willow (*Salix nigra*), Blackbean (*Castanospermum australe*), Blackbutt (*Eucalyptus pilularis*), Blackgum (*Nyssa sylvatica*), Bloodwood (*Brosimum paraense*), Blue Ash (*Fraxinus quadrangulata*), Blue Gum (*Eucalyptus saligna*), Bocote (*Cordia alliodora*), Boxelder (*Acer negundo*), Boxwood (*Buxus sempervirens*), Brazilian walnut (*Swartzia tomentosa*), Brazillian Rosewood (*Dalbergia nigra*), Brazilwood (*Caesalpinia echinata*), Brown Mallet (*Eucalyptus astringens*), Bubing a (*Guibourtia demeusei*), Bur oak (*Quercus macrocarpa*), Butternut (*Juglans cinerea*), California Laurel (*Umbellularia californica*), California Walnut (*Juglans californica*), Camphor Laurel (*Cinnamomum camphora*), Canyon Live Oak (*Quercus chrysolepis*), Cape Chestnut (*Calodendrum capense*), Carapa (*Carapa guianensis*), Catalina Ironwood (*Lyonothamnus floribundus*), Celery Top Pine (*Phyllocladus aspleniifolius*), Chestnut (*Castanea dentata*), Chestnut Oak (*Quercus prinus*), Chinese Mahogany (*Toona sinensis*), Chinkapin Oak (*Quercus muhlenbergii*), Cigar Tree (*Catalpa speciosa*), Claro Walnut (*Juglans hindsii*), Coachwood (*Ceratopetalum apetalum*), Cocobolo (*Dalbergia retusa*), Common Ash (*Fraxinus excelsior*), Common Horse-chestnut (*Aesculus hippocastanum*), Common Ironwood (*Pau ferro*), Corkwood (*Leitneria floridana*), Corsican Pine (*Pinus nigra*), Cucumbertree (*Magnolia acuminata*), cumaru (*Dipyeryx odorata*), Desert Ironwood (*Olneya tesota*), Eastern Cottonwood (*Populus deltoides*), Eastern Hemlock (*Tsuga canadensis*), Eastern Hop hornbeam (*Ostrya virginiana*), Eastern Redcedar (*Juniperus virginiana*), Eastern White Pine (*Pinus strobus*), English Elm (*Ulmus procera*), English Oak (*Quercus robur*), European Aspen (*Populus tremula*), European Beech (*Fagus sylvatica*), European Larch (*Larix decidua*), European Yew (*Taxus baccata*), Flooded Gum (*Eucalyptus grandis*), Flowering Dogwood (*Cornus florida*), Goncalo Alves (*Astronium fraxinifolium*), Gray Birch (*Betula populifolia*), Green Ash (*Fraxinus pennsylvanica*), Greenheart (*Chlorocardium rodiei*), Grey Ironbark (*Eucalyptus paniculata*), Guanandi (*Calophyllum brasiliense*), Hackberry (*Celtis occidentalis*), Hard maple a/k/a Sugar Maple (*Acer saccharum*), Hawaiian Sandalwood (*Santalum freycinetianum*), Hinoki Cypress (*Chamaecyparis obtusa*), Honey Locust (*Gleditsia triacanthos*), Hoop Pine (*Araucania cunninghamii*), Huon Pine (*Lagarostrobos franklinii*), Hybrid Poplar (*Populus canadensis*), Indian Bean Tree (*Catalpa bignonioides*), Indian Rosewood (*Dalbergia sissoo*), Indian Sandalwood (*Santalum album*), Ipe (*Tabebuia serratifolia*), Iroko (*Milicia excelsa*), Ironbark (*Eucalyptus sideroxylon*), Jacaranda (*Jacaranda brasiliana*), Jack Pine (*Pinus banksiana*), Japanese Larch (*Larix kaempferi*), Jarrah (*Eucalyptus marginate*), Jatobá (*Hymenaea courbaril*), Karri (*Eucalyptus diversicolor*), Kauri (*Agathis australis*), Kaya (*Torreya nucifera*), Kingwood (*Dalbergia cearensis*), Lacewood (*Grevillea robusta*), Laurel Oak (*Quercus laurifolia*), Lawson's Cypress (*Chamaecyparis lawsoniana*), Lebombo Ironwood *Androstachys johnsonii*), Lignum Vitae (*Guaiacum officinale*), Limba (*Terminalis superba*), Loblolly Pine (*Pinus taeda*), Lodgepole Pine (*Pinus contorta*), Longleaf Pine (*Pinus palustris*), Marblewood (*Marmaroxylon racemosum*), Marri (*Corymbia calophylla*), Mediterranean Cypress (*Cupressus sempervirens*), Merbau (*Intsia bijuga*), Mockernut Hickory (*Carya alba*), Monterey Pine (*Pinus radiata*), Mountain Hemlock (*Tsuga mertensiana*), Noble Fir (*Abies procera*), Nootka Cypress (*Callitropsis nootkatensis*), Northern Whitecedar (*Thuja occidentalis*), Norway Spruce (*Picea abies*), Nuttall's Oak (*Quercus texana*), Obeche (*Triplochiton scleroxylon*), Ohio Buckeye (*Aesculus glabra*), Okoumé (*Aucoumea klaineana*), Olive (*Olea europaea*), Oregon Ash (*Fraxinus latifolia*), Overcup Oak (*Quercus lyrata*), Pacific Coast Mahogany (*Swietenia humilis*), Pacific Dogwood (*Cornus nuttallii*), Pacific Silver Fir (*Abies amabilis*), Padauk (*Pterocarpus soyauxii*), Panga-panga (*Millettia stuhlmannii*), Paper Birch (*Betula papyrifera*), Parana Pine (*Araucaria angustifolia*), Pear (*Pyrus communis*), Pecan (*Carya illinoinensis*), Pehuén (*Araucaria araucana*), Persian Ironwood (*Parrotia persica*), Pignut Hickory (*Carya glabra*), Pink Ivory (*Berchemia Zeyheri*), Pitch Pine (*Pinus rigida*), Plains Cottonwood (*Populus sargentii*), Ponderosa Pine (*Pinus ponderosa*), Post Oak (*Quercus stellata*), Pumpkin Ash (*Fraxinus profunda*), Purple Heart (*Peltogyne altissima*), Purpleheart (*Peltogyne paniculata*), Quaking Aspen (*Populus tremuloides*), Queensland Maple (*Flindersia brayleyana*), Queensland Walnut (*Endiandra palmerstonii*), Red Alder (*Alnus rubra*), Red Cedar (*Toona ciliata*), Red Cherry (*Prunus pensylvanica*), Red Elm (*Ulmus rubra*), Red Mahogany (*Eucalyptus resinifera*), Red Maple (*Acer rubrum*), Red Oak (*Quercus rubra*), Red Pine (*Pinus resinosa*), Red Spruce (*Picea rubens*), Redgum (*Liquidambar styraciflua*), Redheart (*Erythroxylon mexicanum*), Redwood (*Sequoia sempervirens*), Rimu (*Dacrydium cupressinum*), River Birch (*Betula nigra*), River Red Gum (*Eucalyptus camaldulensis*), Rock Elm (*Ulmus thomasii*), Rocky Mountain Douglas-fir (*Pseudotsuga menziesii*), Rose Chestnut (*Mesua ferrea*), Sal (*Shorea robusta*), Sapele (*Entandrophragma cylindricum*), Sassafras (*Sassafras albidum*), Satinwood (*Chloroxylon swietenia*), Scots Pine (*Pinus sylvestris*), Shagbark Hickory (*Carya ovata*), Shellbark Hickory (*Carya laciniosa*), Sheoak (*Allocasuarina casuarinaceae*), Shortleaf Pine (*Pinus echinata*), Silver Birch (*Betula pendula*), Silver Fir (*Abies alba*), Silver Maple (*Acer saccharinum*), Silver Wattle (*Acacia dealbata*), Sitka Spruce (*Picea sitchensis*), Sonokeling (*Dalbergia latifolia*), Sourwood (*Oxydendrum arboreum*), Southern Blue Gum (*Eucalyptus globulus*), Southern Live Oak (*Quercus virginiana*), Southern Mahogany (*Eucalyptus botryoides*), Southern Red Oak (*Quercus falcata*), Southern Sassafras (*Atherosperma moschatum*), Southern Whitecedar (*Chamaecyparis thyoides*), Spanish-cedar (*Cedrela odorata*), Sugar Pine (*Pinus lambertiana*), Sugi (*Cryptomeria japonica*), Swamp Chestnut Oak (*Quercus michauxii*), Swamp Cottonwood (*Populus heterophylla*), Swamp Mahogany (*Eucalyptus robusta*), Swamp White Oak (*Quercus bicolor*), Sweet Birch (*Betula lenta*), Sycamore Maple (*Acer pseudoplatanus*), Tallowwood (*Eucalyptus microcorys*), Tamarack Larch (*Larix laricina*), Tambotie (*Spirostachys africana*), Tasmanian Oak (*Eucalyptus regnans*), Teak (*Tectona grandis*), Tupelo Gum (*Nyssa aquatica*), Turkish Walnut a/k/a English Walnut (*Juglans regia*), Turpentine (*Syncarpia glomulifera*), Wandoo (*Eucalyptus wandoo*), Water Oak (*Quercus nigra*), Weeping Willow (*Salix babylonica*), Wenge (*Millettia laurentii*), West Indies Mahogany (*Swietenia mahagoni*), Western Hemlock (*Tsuga heterophylla*), Western Larch (*Larix occidentalis*), Western Redcedar (*Thuja plicata*), Western White Pine (*Pinus monticola*), White Ash (*Fraxinus americana*), White Basswood (*Tilia heterophylla*), White Birch (*Betula pubescens*), White Mahogany (*Eucalyptus acmenoides*), White Oak (*Quercus alba*), White Spruce (*Picea glauca*), White Willow (*Salix alba*), Wild Cherry (*Prunus avium*), Willow Oak (*Quercus phellos*), Wych Elm (*Ulmus glabra*), Yellow Birch (*Betula alleghaniensis*), Yellow Birch (*Betula lutea*), Yellow Buckeye (*Aesculus flava*), Yellow Lapacho (*Tabebuia serratifolia*), Yellow Poplar (*Liriodendron tulipifera*), and York Gum (*Eucalyptus loxophleba*).

3. The method of claim 1 wherein the wooden item is one or more of the group of: acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, clarinet body, oboe body, gunstock, knife handle, pool cue, toy game piece, chess piece, baseball bat, bed frame, bench, bookcase, bowl, box, bureau, cabinet, chair, chest, clock casing, coat rack, desk, door, flooring, furniture, musical instrument, nightstand, oar, paddle, rack, religious statuary, serving ware, sporting equipment, table, tool handle, wooden toy, kitchen utensil, window frame, window sill, wood carving, and wooden bathtub.

4. The method of claim 1 further comprising the following step:

F. cut said piece of wood into a finished wooden item; whereby Step F is performed after Step E.

5. The method of claim 4 wherein the piece of wood is cut into the finished wooden item in Step F by use of a computerized finishing machine.

6. The method of claim 1 wherein the wood dried in Step B is dried in a kiln.

7. The method of claim 1 wherein the wood dried in Step B is air dried.

8. The method of claim 1 wherein the wood heated in Step D is heated for between 36 and 72 hours.

9. The method of claim 1 further comprising the following step:

D'. during Step D, apply a treatment to said piece of wood; whereby Step D' is performed concurrently with Step D.

10. The method of claim 9 wherein the treatment applied in Step D' is a coolant.

11. The method of claim 10 wherein the coolant applied in Step D' is water.

12. The method of claim 11 wherein the water applied in Step D' is in the form of steam.

13. The method of claim 11 wherein the water applied in Step D' is in liquid form.

14. The method of claim 9 wherein the treatment in Step D' is applied periodically to the piece of wood.

15. The method of claim 9 wherein the treatment applied in Step D' is applied continuously to the piece of wood.

16. The method of claim 1 further comprising the following step:

A'. create a rough wooden item from the piece of wood; whereby Step A' is performed after Step A and before Step B.

17. The method of claim 16 wherein the wooden item is one or more of the group of: acoustic guitar fingerboard, electric guitar fingerboard, steel guitar fingerboard, guitar tuning peg, guitar bridge, guitar tail piece, banjo fingerboard, banjo tuning peg, banjo bridge, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, clarinet body, oboe body, gunstock, knife handle, pool cue, toy game piece, chess piece, baseball bat, bed frame, bench, bookcase, bowl, box, bureau, cabinet, chair, chest, clock casing, coat rack, desk, door, flooring, furniture, musical instrument, nightstand, oar, paddle, rack, religious statuary, serving ware, sporting equipment, table, tool handle, wooden toy, kitchen utensil, window frame, window sill, wood carving, and wooden bathtub.

18. The method of claim 16 further comprising the following step:

F. create a finished wooden item from said rough wooden item;

whereby Step F is performed after Step E.

19. The method of claim 18 wherein the rough wooden item is cut into the finished wooden item in Step F by use of a computerized finishing machine.

20. A method of preparing a wooden item, said method comprising the following steps:

A. obtain a rough wooden item;

B. dry said rough wooden item until said rough wooden item has a moisture content of less than fifteen percent;

C. place said rough wooden item into an oven heated to between 150° C. and 240° C.;

D. allow said rough wooden item to be heated by oven for between 2 and 96 hours such that said rough wooden item achieves an internal temperature of at least 150° C.; and E. remove said rough wooden item from oven and allow said rough wooden item to cool to substantially room temperature;

whereby Steps A through E are to be performed consecutively.

21. The method of claim 20 wherein the rough wooden item obtained in Step A is created from a piece of wood chosen from the group of the following species of tree: African Blackwood (*Dalbergia melanoxylon*), African Zebrawood (*Microberlinia brazzavillensis*), Afzelia (*Afzelia africana*), Agba (*Gossweilerodendron balsamiferum*), American Basswood (*Tilia americana*), American Beech (*Fagus grandifolia*), American Elm (*Ulmus americana*), American Hornbeam (*Carpinus caroliniana*), American Sycamore (*Platanus occidentalis*), Applewood (*Malus sylvestris*), Arizona Cypress (*Cupressus arizonica*), Australian Blackwood (*Acacia melanoxylon*), Australian Ironwood (*Casuarina equisetifolia*), Australian Sandalwood (*Santalum spicatum*), Ayan (*Distemonanthus benthamianus*), Bald Cypress (*Taxodium distichum*), Balsam Fir (*Abies balsamea*), Balsam Poplar (*Populus balsamifera*), Bigleaf Mahogany (*Swietenia macrophylla*), Bigtooth Aspen (*Populus grandidentata*), Black Alder (*Alnus glutinosa*), Black Ash (*Fraxinus nigra*), Black Cherry (*Prunus serotina*), Black Ironwood (*Krugiodendron ferreum*), Black Locust (*Robinia pseudacacia*), Black Maple (*Acer nigrum*), Black Oak (*Quercus velutina*), Black Poplar (*Populus nigra*), Black Spruce (*Picea mariana*), Black Walnut (*Juglans nigra*), Black Willow (*Salix nigra*), Blackbean (*Castanospermum australe*), Blackbutt (*Eucalyptus pilularis*), Blackgum (*Nyssa sylvatica*), Bloodwood (*Brosimum paraense*), Blue Ash (*Fraxinus quadrangulata*), Blue Gum (*Eucalyptus saligna*), Bocote (*Cordia alliodora*), Boxelder (*Acer negundo*), Boxwood (*Buxus sempervirens*), Brazilian walnut (*Swartzia tomentosa*), Brazillian Rosewood (*Dalbergia nigra*), Brazilwood (*Caesalpinia echinata*), Brown Mallet (*Eucalyptus astringens*), Bubing a (*Guibourtia demeusei*), Bur oak (*Quercus macrocarpa*), Butternut (*Juglans cinerea*), California Laurel (*Umbellularia californica*), California Walnut (*Juglans californica*), Camphor Laurel (*Cinnamomum camphora*), Canyon Live Oak (*Quercus chrysolepis*), Cape Chestnut (*Calodendrum capense*), Carapa (*Carapa guianensis*), Catalina Ironwood (*Lyonothamnus floribundus*), Celery Top Pine (*Phyllocladus aspleniifolius*), Chestnut (*Castanea dentata*), Chestnut Oak (*Quercus prinus*), Chinese Mahogany (*Toona sinensis*), Chinkapin Oak (*Quercus muhlenbergii*), Cigar Tree (*Catalpa speciosa*), Claro Walnut (*Juglans hindsii*), Coachwood (*Ceratopetalum apetalum*), Cocobolo (*Dalbergia retusa*), Common Ash (*Fraxinus excelsior*), Common Horse-chestnut (*Aesculus hippocastanum*), Common Ironwood (*Pau ferro*), Corkwood (*Leitneria floridana*), Corsican Pine (*Pinus nigra*), Cucumbertree (*Magnolia acuminata*), cumaru (*Dipyeryx odorata*), Desert Ironwood (*Olneya tesota*), Eastern Cottonwood (*Populus deltoides*), Eastern Hemlock (*Tsuga canadensis*), Eastern Hop hornbeam (*Ostrya virginiana*), Eastern Redcedar (*Juniperus virginiana*), Eastern White Pine (*Pinus strobus*), English Elm (*Ulmus procera*), English Oak (*Quercus robur*), European Aspen (*Populus tremula*), European Beech (*Fagus sylvatica*), European Larch (*Larix decidua*), European Yew (*Taxus baccata*), Flooded Gum (*Eucalyptus grandis*), Flowering Dogwood (*Cornus florida*), Goncalo Alves (*Astronium fraxinifolium*), Gray Birch (*Betula populifolia*), Green Ash (*Fraxinus pennsylvanica*), Greenheart (*Chlorocardium rodiei*), Grey Ironbark (*Eucalyptus paniculata*), Guanandi (*Calophyllum brasiliense*), Hackberry (*Celtis occidentalis*), Hard maple a/k/a Sugar Maple (*Acer saccharum*), Hawaiian Sandalwood (*Santalum freycinetianum*), Hinoki Cypress (*Chamaecyparis obtusa*), Honey Locust (*Gleditsia triacanthos*), Hoop Pine (*Araucania cunninghamii*), Huon Pine (*Lagarostrobos franklinii*), Hybrid Poplar (*Populus canadensis*), Indian Bean Tree (*Catalpa bignonioides*), Indian Rosewood (*Dalbergia sissoo*), Indian Sandalwood (*Santalum album*), Ipe (*Tabebuia serratifolia*), Iroko (*Milicia excelsa*), Ironbark (*Eucalyptus sideroxylon*), Jacaranda (*Jacaranda brasiliana*), Jack Pine (*Pinus banksiana*), Japanese Larch (*Larix kaempferi*), Jarrah (*Eucalyptus marginate*), Jatobá (*Hymenaea courbaril*), Karri (*Eucalyptus diversicolor*), Kauri (*Agathis australis*), Kaya (*Torreya nucifera*), Kingwood (*Dalbergia cearensis*), Lacewood (*Grevillea robusta*), Laurel Oak (*Quercus laurifolia*), Lawson's Cypress (*Chamaecyparis lawsoniana*), Lebombo Ironwood *Androstachys johnsonii*), Lignum Vitae (*Guaiacum officinale*), Limba (*Terminalis superba*), Loblolly Pine (*Pinus taeda*), Lodgepole Pine (*Pinus contorta*), Longleaf Pine (*Pinus palustris*), Marblewood (*Marmaroxylon racemosum*), Marri (*Corymbia calophylla*), Mediterranean Cypress (*Cupressus sempervirens*), Merbau (*Intsia bijuga*), Mockernut Hickory (*Carya alba*), Monterey Pine (*Pinus radiata*), Mountain Hemlock (*Tsuga mertensiana*), Noble Fir (*Abies procera*), Nootka Cypress (*Callitropsis nootkatensis*), Northern Whitecedar (*Thuja occidentalis*), Norway Spruce (*Picea abies*), Nuttall's Oak (*Quercus texana*), Obeche (*Triplochiton scleroxylon*), Ohio Buckeye (*Aesculus glabra*), Okoumé (*Aucoumea klaineana*), Olive (*Olea europaea*), Oregon Ash (*Fraxinus latifolia*), Overcup Oak (*Quercus lyrata*), Pacific Coast Mahogany (*Swietenia humilis*), Pacific Dogwood (*Cornus nuttallii*), Pacific Silver Fir (*Abies amabilis*), Padauk (*Pterocarpus soyauxii*), Panga-panga (*Millettia stuhlmannii*), Paper Birch (*Betula papyrifera*), Parana Pine (*Araucaria angustifolia*), Pear (*Pyrus communis*), Pecan (*Carya illinoinensis*), Pehuén (*Araucaria araucana*), Persian Ironwood (*Parrotia persica*), Pignut Hickory (*Carya glabra*), Pink Ivory (*Berchemia Zeyheri*), Pitch Pine (*Pinus rigida*), Plains Cottonwood (*Populus sargentii*), Ponderosa Pine (*Pinus ponderosa*), Post Oak (*Quercus stellata*), Pumpkin Ash (*Fraxinus profunda*), Purple Heart (*Peltogyne altissima*), Purpleheart (*Peltogyne paniculata*), Quaking Aspen (*Populus tremuloides*), Queensland Maple (*Flindersia brayleyana*), Queensland Walnut (*Endiandra palmerstonii*), Red Alder (*Alnus rubra*), Red Cedar (*Toona ciliata*), Red Cherry (*Prunus pensylvanica*), Red Elm (*Ulmus rubra*), Red Mahogany (*Eucalyptus resinifera*), Red Maple (*Acer rubrum*), Red Oak (*Quercus rubra*), Red Pine (*Pinus resinosa*), Red Spruce (*Picea rubens*), Redgum (*Liquidambar styraciflua*), Redheart (*Erythroxylon mexicanum*), Redwood (*Sequoia sempervirens*), Rimu (*Dacrydium cupressinum*), River Birch (*Betula nigra*), River Red Gum (*Eucalyptus camaldulensis*), Rock Elm (*Ulmus thomasii*), Rocky Mountain Douglas-fir (*Pseudotsuga menziesii*), Rose Chestnut (*Mesua ferrea*), Sal (*Shorea robusta*), Sapele (*Entandrophragma cylindricum*), Sassafras (*Sassafras albidum*), Satinwood (*Chloroxylon swietenia*), Scots Pine (*Pinus sylvestris*), Shagbark Hickory (*Carya ovata*), Shellbark Hickory (*Carya laciniosa*), Sheoak (*Allocasuarina casuarinaceae*), Shortleaf Pine (*Pinus echinata*), Silver Birch (*Betula pendula*), Silver Fir (*Abies alba*), Silver Maple (*Acer saccharinum*), Silver Wattle (*Acacia dealbata*), Sitka Spruce (*Picea sitchensis*), Sonokeling (*Dalbergia latifolia*), Sourwood (*Oxydendrum arboreum*), Southern Blue Gum (*Eucalyptus globulus*), Southern Live Oak (*Quercus virginiana*), Southern Mahogany (*Eucalyptus botryoides*), Southern Red Oak (*Quercus falcata*), Southern Sassafras (*Atherosperma moschatum*), Southern Whitecedar (*Chamaecyparis thyoides*), Spanish-cedar (*Cedrela odorata*), Sugar Pine (*Pinus lambertiana*), Sugi (*Cryptomeria japonica*), Swamp Chestnut Oak (*Quercus michauxii*), Swamp Cottonwood (*Populus heterophylla*), Swamp Mahogany (*Eucalyptus robusta*), Swamp White Oak (*Quercus bicolor*), Sweet Birch (*Betula lenta*), Sycamore Maple (*Acer pseudoplatanus*), Tallowwood (*Eucalyptus microcorys*), Tamarack Larch (*Larix laricina*), Tambotie (*Spirostachys africana*), Tasmanian Oak (*Eucalyptus regnans*), Teak (*Tectona grandis*), Tupelo Gum (*Nyssa aquatica*), Turkish Walnut a/k/a English Walnut (*Juglans regia*), Turpentine (*Syncarpia glomulifera*), Wandoo (*Eucalyptus wandoo*), Water Oak (*Quercus nigra*), Weeping Willow (*Salix babylonica*), Wenge (*Millettia laurentii*), West Indies Mahogany (*Swietenia mahagoni*), Western Hemlock (*Tsuga heterophylla*), Western Larch (*Larix occidentalis*), Western Redcedar (*Thuja plicata*), Western White Pine (*Pinus monticola*), White Ash (*Fraxinus americana*), White Basswood (*Tilia heterophylla*), White Birch (*Betula pubescens*), White Mahogany (*Eucalyptus acmenoides*), White Oak (*Quercus alba*), White Spruce (*Picea glauca*), White Willow (*Salix alba*), Wild Cherry (*Prunus avium*), Willow Oak (*Quercus phellos*), Wych Elm (*Ulmus glabra*), Yellow Birch (*Betula alleghaniensis*), Yellow Birch (*Betula lutea*), Yellow Buckeye (*Aesculus flava*), Yellow Lapacho (*Tabebuia serratifolia*), Yellow Poplar (*Liriodendron tulipifera*), and York Gum (*Eucalyptus loxophleba*).

22. The method of claim 20 wherein the wooden item is one or more of the group of:

acoustic guitar fingerboard, electric guitar fingerboard, steel guitar fingerboard, guitar tuning peg, guitar bridge, guitar tail piece, banjo fingerboard, banjo tuning peg, banjo bridge, banjo tail piece, violin fingerboard, violin tuning peg, violin bridge, violin tail piece, violin chin rest, viola fingerboard, viola tuning peg, viola bridge, viola tail piece, viola chin rest, cello fingerboard, cello tuning peg, cello bridge, cello tail piece, double bass fingerboard, double bass tuning peg, double bass bridge, double bass tail piece, mandolin fingerboard, mandolin tuning peg, mandolin bridge, mandolin tail piece, piano key, organ key, clarinet body, oboe body, gunstock, knife handle, pool cue, toy game piece, chess piece, baseball bat, bed frame, bench, bookcase, bowl, box, bureau, cabinet, chair, chest, clock casing, coat rack, desk, door, flooring, furniture, musical instrument, nightstand, oar, paddle, rack, religious statuary, serving ware, sporting equipment, table, tool handle, wooden toy, kitchen utensil, window frame, window sill, wood carving, and wooden bathtub.

23. The method of claim 20 further comprising the following step:

F. create a finished wooden item from said rough wooden item;

whereby Step F is performed after Step E.

24. The method of claim 23 wherein the rough wooden item is cut into the finished wooden item in Step F by use of a computerized finishing machine.

* * * * *